US007506616B2

(12) United States Patent
Calvert

(10) Patent No.: US 7,506,616 B2
(45) Date of Patent: Mar. 24, 2009

(54) DUAL FUEL AIR CONDITIONING CIRCUIT-BASED WATER HEATER

(75) Inventor: Clifford William Calvert, Prattville, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 117 days.

(21) Appl. No.: 11/680,964

(22) Filed: Mar. 1, 2007

(65) Prior Publication Data

US 2008/0210177 A1 Sep. 4, 2008

(51) Int. Cl.
*F24H 1/00* (2006.01)

(52) U.S. Cl. ..... 122/4 A; 122/13.01; 126/392.1

(58) Field of Classification Search ..... 122/4 A, 122/13.01, 14.1, 17.1, 20 R, 169; 126/344, 126/369.1, 376.1, 392.1, 361.1; 237/8 B, 237/19, 62

See application file for complete search history.

(56) References Cited

U.S. PATENT DOCUMENTS 3,773,019 A * 11/1973 Hapgood ..... 122/33
3,786,860 A * 1/1974 Huggins ..... 165/50
3,800,747 A * 4/1974 Hapgood ..... 122/235.11
4,134,448 A * 1/1979 Luksus ..... 165/62
4,146,089 A 3/1979 Mueller et al.
4,179,902 A 12/1979 Mueller et al.
4,363,221 A 12/1982 Singh
4,514,990 A 5/1985 Sulkowski
4,750,452 A * 6/1988 Trihey ..... 122/24
4,798,240 A 1/1989 Gerstmann et al.
4,947,656 A * 8/1990 Alvisi ..... 62/235.1
5,074,464 A 12/1991 Moore, Jr. et al.
5,305,614 A 4/1994 Gilles
5,533,362 A * 7/1996 Cook et al. ..... 62/476
5,546,760 A * 8/1996 Cook et al. ..... 62/497
6,109,339 A 8/2000 Talbert et al.
6,283,067 B1 * 9/2001 Akkala ..... 122/14.22
2008/0120986 A1 * 5/2008 Al-Hashash ..... 62/238.6

OTHER PUBLICATIONS

Solahart Brochure Sheets—"The Solahart Synergy" (undated).

* cited by examiner

*Primary Examiner*—Gregory A Wilson
(74) *Attorney, Agent, or Firm*—Haynes and Boone, LLP

(57) ABSTRACT

A fuel-fired water heater is coupled to an electrically powered air conditioning refrigerant circuit in a manner permitting water to be heated with either combustible fuel or electricity. In one embodiment a condenser piping section is externally coiled around the water heater tank, in direct thermally conductive contact therewith, and in another embodiment the condenser piping section is disposed in the interior of the tank and is coiled around the water heater flue in a laterally outwardly spaced relationship therewith. In various depicted arrangements thereof the other refrigerant circuit components are compactly supported on the water heater.

27 Claims, 6 Drawing Sheets

DUAL FUEL AIR CONDITIONING CIRCUIT-BASED WATER HEATER

BACKGROUND OF THE INVENTION

The present invention generally relates to liquid heating apparatus and, in representatively illustrated embodiments thereof, more particularly provides water heaters that are able to selectively utilize either a fuel burner structure or rejected air conditioning circuit heat to heat water stored in a tank portion of the water heater.

In the past, various proposals have been made to utilize heat rejected from an air conditioning refrigerant circuit to heat water disposed in a storage vessel. Previously proposed systems for transferring rejected refrigerant circuit heat to stored water typically have associated therewith various well known problems, limitations and disadvantages which include requiring an undesirably large amount of installation space, being mechanically complex, and requiring relatively complicated control systems.

For these reasons it would be desirable to provide an improved system for transferring rejected refrigerant circuit heat to stored liquid which eliminated, or at least substantially reduced the above-mentioned problems, limitations and disadvantages associated with previously proposed refrigerant circuit heat transfer systems of the type generally described above. It would also be desirable to provide a refrigerant circuit-based water heater system that could utilize a selectively variable one of two separate fuels to carry out its water heating function.

SUMMARY OF THE INVENTION

In carrying out principles of the present invention, in accordance with representatively illustrated embodiments thereof, specially designed apparatus is provided for heating a liquid using either combustible fuel or electricity. Illustratively, the apparatus is used to heat water, but could alternatively be utilized to heat other liquids without departing from principles of the present invention.

In a representatively illustrated embodiment thereof, the apparatus includes a fuel-fired liquid heater, representatively a water heater, having a tank for storing liquid for selective outflow from the tank, a fuel burner operative to create hot combustion gases, and a flue, extending through the interior of the tank, for receiving the hot combustion gases and transferring heat therefrom to liquid disposed in the tank. The apparatus further includes an electrically powered air conditioning refrigerant circuit having a condenser portion including a piping structure disposed in an interior portion of the liquid heater and operative to transfer rejected condenser portion heat to liquid in the tank during operation of the air conditioning circuit.

According to one aspect of the invention, the interior liquid heater portion within which the condenser portion piping structure is disposed in an insulation space between an outer jacket portion of the liquid heater and an exterior surface portion of the tank spaced inwardly apart from the jacket, and the piping structure is in direct heat transfer contact with the exterior tank surface. Preferably, the piping structure is in a coiled configuration which circumscribes an axis of the tank.

In accordance with a further aspect of the invention, the interior liquid heater portion within which the condenser portion piping structure is disposed is the interior of the tank.

Preferably, the piping structure in this embodiment is coiled around the flue, which illustratively extends along the aforementioned axis, in a laterally outwardly spaced relationship therewith.

According to yet another aspect of the invention, the coiled piping structure which surrounds the flue is supported thereon by a specially designed support structure which defines a heat conduction barrier between the flue and the coiled piping structure. Preferably, the support structure includes a circumferentially spaced series of elongated thermally insulative members, longitudinally extending generally parallel to the flue, which are held radially outwardly apart from the flue, around which the piping structure is coiled, with each coil of the piping structure being positioned between spaced pairs of lateral support projections disposed on the elongated thermally insulative members.

In accordance with another aspect of the invention the air conditioning refrigerant circuit non-condenser components, including its compressor, expansion and evaporator portions, are compactly packaged with the liquid heater portion of the overall system in several representative manners. Illustratively, the liquid heater has a housing supported thereon and having spaced apart inlet and outlet openings therein through which air may be respectively received and discharged, with at least the compressor portion of the air conditioning circuit being disposed in the housing. In one representative version of this compact packaging aspect of the invention, the evaporator portion of the circuit is mounted atop the water heater outside of the aforementioned housing.

According to yet another aspect of the invention, a control system is provided which is operable to selectively (1) permit operation of the fuel burner and lock out operation of the refrigerant circuit, or (2) operate the refrigerant circuit and preclude operation of the fuel burner. The control system may include an outdoor temperature sensor operative to output a temperature signal when the sensed outdoor temperature is below a predetermined magnitude, with the control system being further operable to lock out operation of the refrigerant circuit in response to generation of such temperature signal.

DETAILED DESCRIPTION

Figure 2:
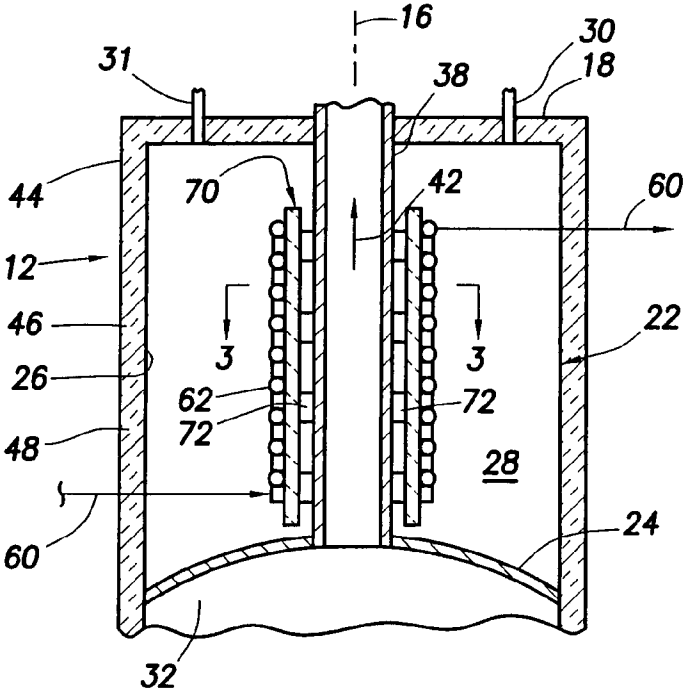
FIG. 2 is an enlarged scale cross-sectional detail view of the dashed area "2" in FIG. 1.
Figure 1:
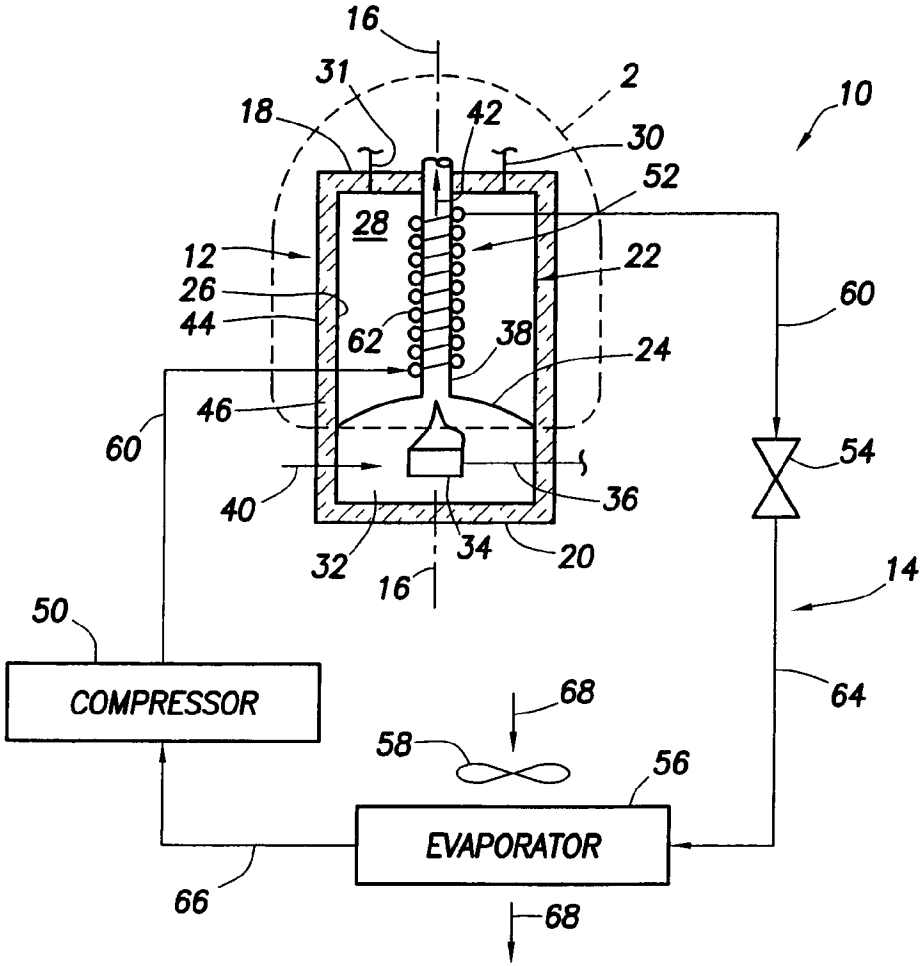
FIG. 1 is a schematic circuit diagram of a dual fuel, air conditioning circuit-based water heater system embodying principles of the present invention.

Referring initially to FIGS. 1 and 2, in a representatively illustrated embodiment thereof the present invention provides a specially designed dual fuel air conditioning circuit-based water heater system 10 that includes a fuel-fired water heater 12, representatively a gas-fired water heater, and an electrically powered air conditioning refrigerant circuit 14 uniquely incorporated into the water heater 12 as later described herein. As will be seen, the water heater 12 may be advantageously operated using either a combustible fuel or electrical power. While the present invention is being representatively illustrated and described herein as being implemented in conjunction with a water heater, it will be readily appreciated by those of skill in this particular art that principles of the invention could be employed to advantage in conjunction with apparatus for heating liquids other than water.

Water heater 12 has a representatively cylindrical, vertically oriented configuration centered about a vertical axis 16, and has top and bottom ends 18,20 spaced apart along axis 16. A metal storage tank 22 extends downwardly from adjacent the top end 18 of the water heater 12 and has a domed bottom wall 24 and a vertically extending annular exterior sidewall portion 26. A quantity of pressurized hot water 28 is disposed within the tank 22 for on-demand delivery to various plumbing fixtures via a hot water outlet pipe 30 connected to the top end of the tank 22. Hot water discharged from the tank 22 in this manner is automatically replenished with pressurized supply water flowing inwardly through a water inlet pipe 31 connected to the top end of the tank 22.

The bottom tank wall 24 forms the top wall of an underlying combustion chamber 32 that is in thermal communication with the interior of the tank 22 and has operatively disposed therein a fuel burner 34 which is representatively a gas burner supplied with fuel via a suitable gas supply line 36. A flue pipe 38 communicates at its lower end with the interior of the combustion chamber 32 and extends from the combustion chamber 32 upwardly through the interior of the tank 22 along the axis 16. During firing of the water heater 12, which may be of either a natural draft or forced draft type, fuel delivered to the burner 34 is mixed with combustion air 40 suitably delivered to the combustion chamber 32 and burned to form hot combustion products 42 that pass upwardly through and are discharged from the flue pipe 38. Heat from the combustion products 42 upwardly traversing the flue pipe 38 is transferred to the tank water 28 to heat it.

Outwardly surrounding the tank 22 is a metal jacket 44 that forms with the exterior side wall 26 of the tank 22 an annular insulation space 46. Insulation space 46, which defines an interior portion of the water heater 12, is filled with a suitable insulation material 48 which may be, for example, foamed-in insulation.

The electrically powered air conditioning refrigerant circuit 14 includes a compressor 50, a condenser portion 52, an expansion valve 54, and an evaporator 56 with an associated evaporator fan 58. Compressor 50 is coupled to the expansion valve 54 by a length of refrigerant piping 60 extending between the outlet of the compressor 50 and the inlet of the expansion valve 54. The condenser portion 52, which is interposed between the compressor 50 and the expansion valve 54, is defined by a central coiled portion 62 of the refrigerant piping 60. The outlet of the expansion valve 54 is coupled to the inlet of the evaporator 56 by a length of refrigerant piping 64, and the outlet of the evaporator 56 is coupled to the inlet of the compressor 50 by a length of refrigerant piping 66. As indicated by the piping arrows in FIG. 1, during operation of the refrigerant circuit 14, refrigerant is discharged from the compressor 50 via piping 60, and then forced through the condensing portion 62, the expansion valve 54 and back to the inlet of the compressor 50 sequentially via the refrigerant piping sections 60,64,66. During electrically powered operation of the air conditioning refrigerant circuit 14, the circulating refrigerant discharges heat from the condenser portion 52, and air 68 is blown by the fan 58 across the evaporator 56, and cooled thereby, for delivery to a conditioned space served by the circuit 14.

Figure 4:
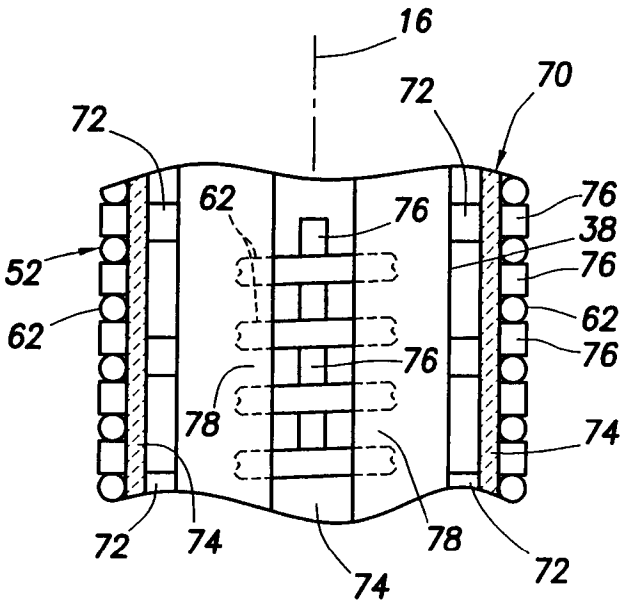
FIG. 4 is a side elevational view of the flue and condenser coil portion taken along line 4-4 of FIG. 3.
Figure 3:
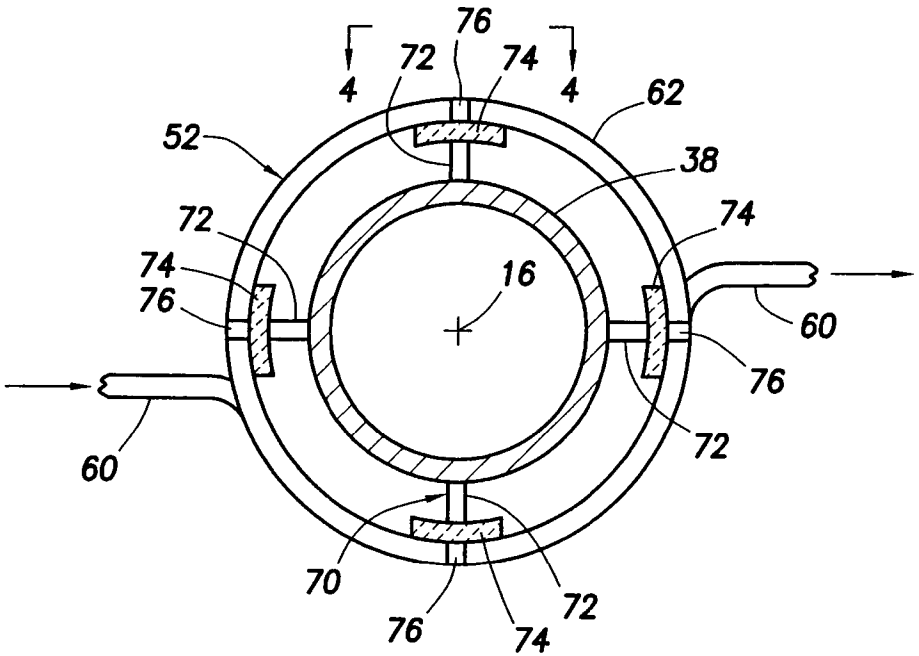
FIG. 3 is an enlarged scale cross-sectional view through a flue and condenser coil portion of the water heater taken along line 3-3 of FIG. 2.

Referring now to FIGS. 2-4, according to a feature of the present invention, the coiled pipe condenser portion 52 is compactly disposed within an interior portion of the water heater 12—namely the interior of the tank 22 in which the condenser portion 52 circumscribes the flue pipe 38 (and thus the axis 16 as well) in a laterally outwardly spaced relationship therewith. The coiled condenser portion 52 is supported in such laterally outwardly spaced relationship with the flue pipe 38 by a specially designed support structure 70 that thermally insulates the coiled condenser piping section 62 from the high temperature of the flue pipe 38 when the water heater 12 is being fuel-fired. When the air conditioning circuit 14 is being electrically operated, refrigerant heat rejected from the coiled pipe section 62 of the circuit condenser portion 52 is transferred directly to the surrounding tank water 28 to heat the water.

Support structure 70, which forms a heat conduction barrier between the coiled refrigerant piping section 62 and the flue pipe 38, representatively includes circumferentially spaced vertical rows of radially outwardly projecting metal struts 72 welded to the vertical side wall of the flue pipe 38. The outer ends of struts 72 are anchored to a circumferentially spaced series of vertically elongated support members 74 which are formed from a thermally insulative material which is representatively a ceramic material. A series of vertically spaced projections 76 are formed on the outer side of each of the support members 74. As best illustrated in FIG. 4, each coil of the coiled condenser pipe section 62 is wrapped around the outer sides of the vertically elongated support members 74 between a vertically adjacent pair of projections 76, such projections 76 serving to vertically support the coils of the pipe section 62 as well as to define spaces 78 (see FIG. 4) between adjacent piping coils to facilitate water contact with the flue pipe 38, and convective water flow laterally through the coiled pipe section 62, when the water heater 12 is being fuel-fired.

The uniquely configured dual fuel system 10 just described permits either combustible fuel or electrical power to be used to heat the water 28 in the water heater storage tank 22. By turning off the water heater 12 (which prevents firing of its fuel burner 34) and starting the air conditioning refrigerant circuit 14, electrical power is utilized via the condenser portion's rejection of heat to the water 28. On the other hand, by turning off the refrigerant circuit 14 and turning the water heater 12 on, combustible fuel may be utilized via the firing of the fuel burner 34. In this manner the user of the system 10 could use one fuel when the other fuel is at a higher rate, or such other fuel is on a restricted use basis such as sometimes occurs in certain areas of the U.S. The illustrated air conditioning refrigerant circuit 14 is representatively a cooling-only circuit, but a reversible heat pump type of refrigerant circuit could be alternatively utilized if desired.

Figure 12:
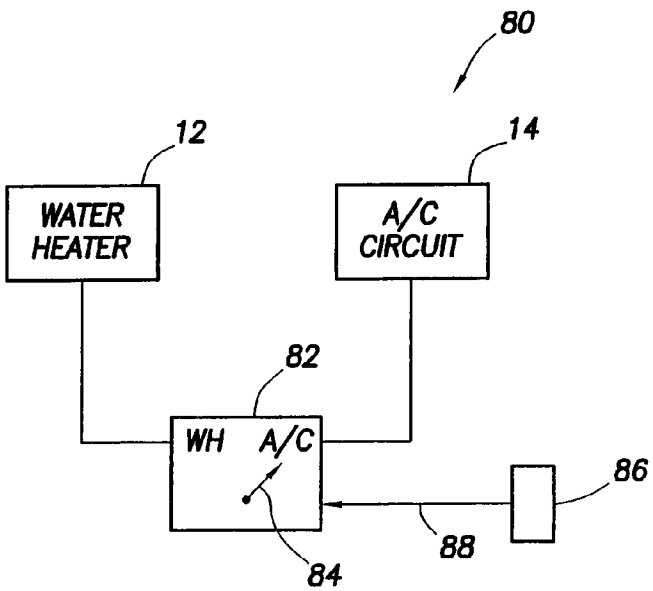
FIG. 12 is a schematic circuit diagram of a control system that may be utilized with any of the representatively depicted water heater embodiments and their associated air conditioning circuits.

With reference now to FIG. 12, a simple control system 80 may representatively be utilized to select between fuel-fired and electrically powered water heating in the system 10. System 80 includes a suitable electrical controller 82 appropriately coupled to the fuel-fired water heater 12 and the air conditioning circuit 14. Controller 82 has a manual switch portion 84 movable between (1) a "WH" position in which the controller 82 permits the conventional control system of the water heater 12 (not illustrated) to initiate normal fuel-fired water heater operation, and locks out the operation of the air conditioning circuit 14, and (2) an "AC" position in which operation of the circuit 14 is initiated and fuel-fired operation of the water heater 12 is locked out. Control system 80 may also include a thermostat 86 that senses the outdoor temperature and responsively transmits to the controller 82 a temperature signal 88 when the sensed outdoor temperature falls below a predetermined set point level. In response to receipt of the signal 88, the controller 82 locks out operation of the air conditioning circuit 14 and permits the water heater 12 to operate under its normal fuel-fired mode.

Figure 5:
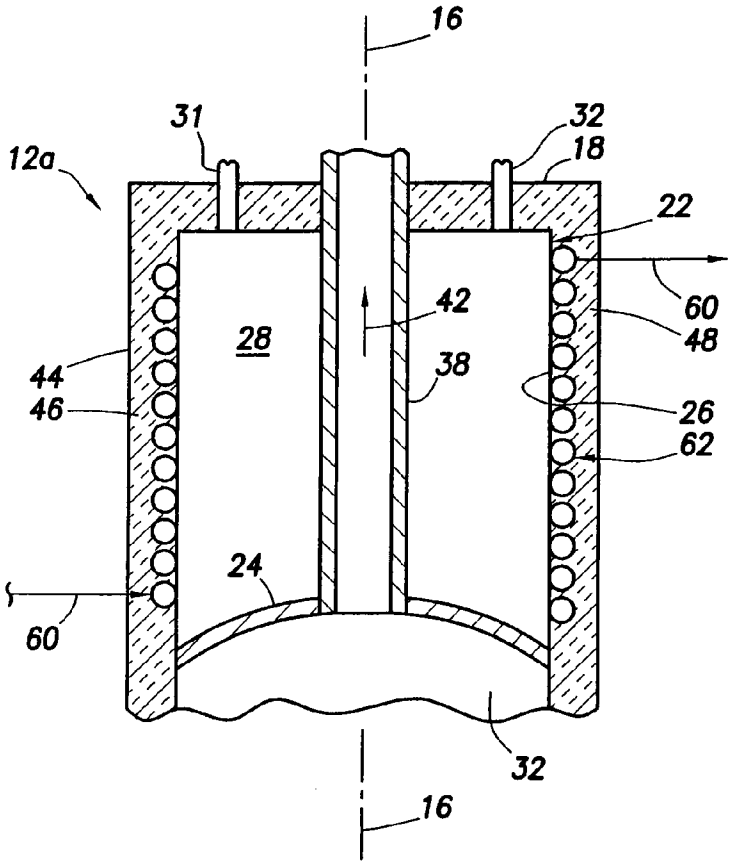
FIG. 5 is a cross-sectional detail view, similar to that in FIG. 2, of a first alternate embodiment of the water heater.

Cross-sectionally depicted in FIG. 5 is an upper portion of a first alternate embodiment 12*a* of the previously described water heater portion 12 of the overall dual fuel system 10. Water heater 12*a* is representatively identical to the water heater 12 with the exception that the coiled refrigerant piping section 62 of the air conditioning circuit condenser portion 52, instead of being coiled around the flue pipe 38, is disposed within the jacket insulation space 46 (an interior portion of the water heater 12*a*) and coiled around the outer surface of the tank side wall 26 (and thus around the axis 16) in direct heat conductive contact with the outer surface of the tank wall 26. When the system 10 is switched to its electrical power mode, refrigerant heat rejected from the coiled condenser section 62 is conductively transferred inwardly through the tank wall 26 to the stored water 28 which it surrounds. As in the case of the previously described water heater 12, the water heater 12*a* may be either a natural draft or forced draft water heater.

Figure 6:
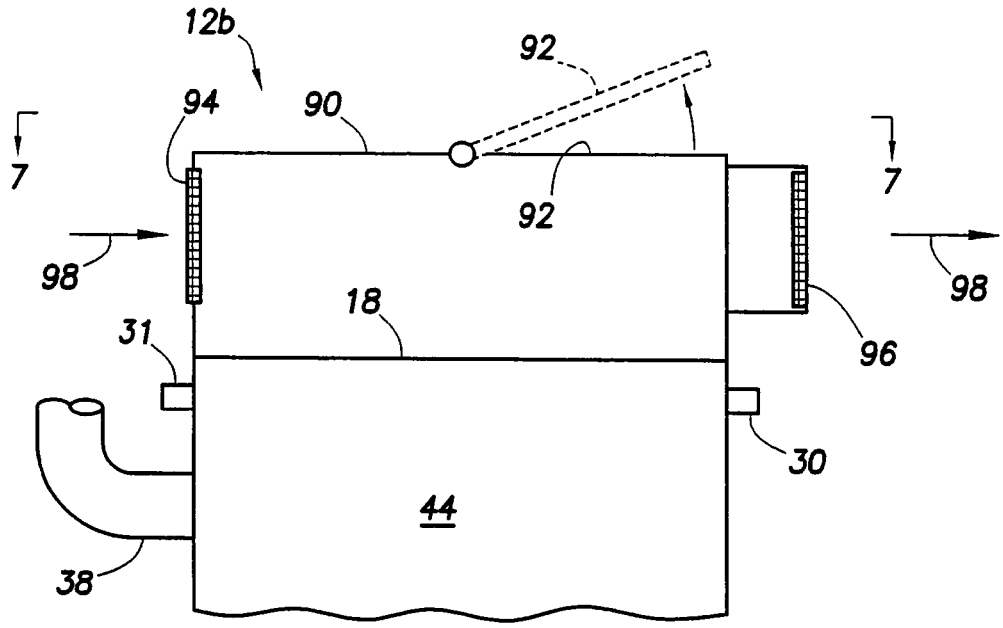
FIG. 6 is a simplified side elevational view of a top portion of a second alternate embodiment of the water heater.
Figure 7:
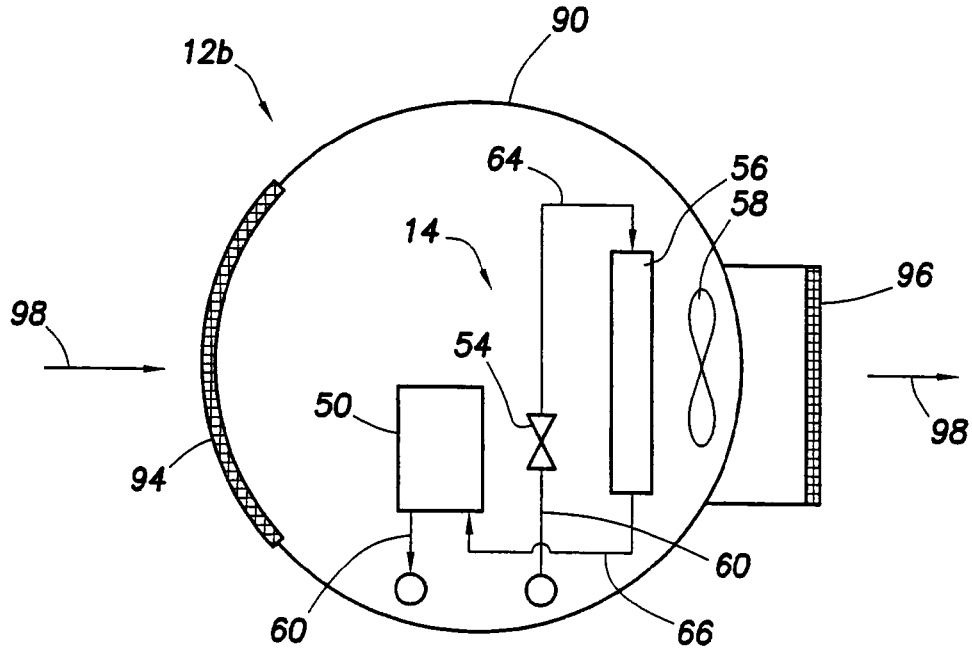
FIG. 7 is a cross-sectional view through the FIG. 6 water heater taken along line 7-7 of FIG. 6.

An upper portion of a second alternate embodiment 12*b* of the previously described water heater portion 12 of the dual fuel system 10 is schematically shown in FIGS. 6 and 7. Water heater 12*b* may incorporate in an interior portion thereof the coiled air conditioning circuit condenser piping section 62 as utilized in either of the previously described water heater embodiments 12 and 12*a*, and additionally provides a compact arrangement of the non-condenser components of the air conditioning circuit 14 as will now be described.

In the water heater 12*b* the flue pipe 38 and the water outlet and inlet pipes 30,31 exit the water heater on side portions thereof somewhat below its top end 18. Positioned atop the upper end 18 of the water heater 12*b* is a housing 90 in which the compressor 50, the expansion valve 54, the evaporator 56 and the evaporator fan 58 are disposed. Access to the interior of the housing 90 may be provided via an upwardly pivotable access cover plate 92 on the top of the housing 90. An air inlet grille 94 is mounted in an opening in one vertical side portion of the housing 90, and an air outlet grille 96 is mounted in an opening in an opposite vertical side portion of the housing 90. During operation of the circuit 14, ambient air 98 adjacent the water heater 12*b* is drawn into the housing 90 through the inlet grille 94, by operation of the evaporator fan 58, flowed across the evaporator 56 to cool the air, and then discharged as cooled air 98 from the outlet grille 96 to a conditioned space. Such conditioned space may be near the water heater 12*b* or remote therefrom. As in the case of the previously described water heaters 12,12*a*, the water heater 12*b* may be either a natural draft or forced draft water heater.

Figure 8:
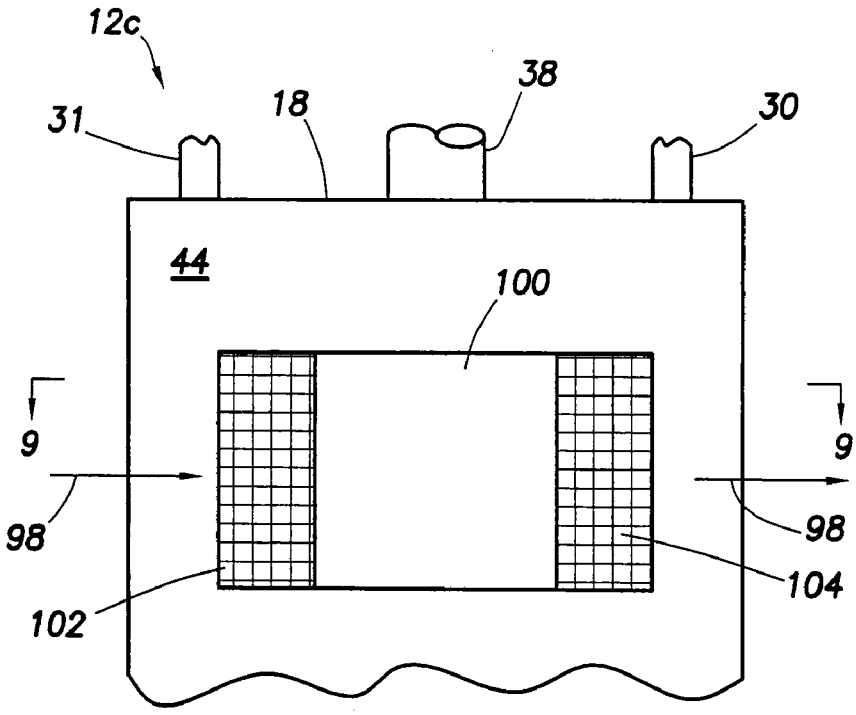
FIG. 8 is a simplified side elevational view of a top portion of a third alternate embodiment of the water heater.
Figure 9:
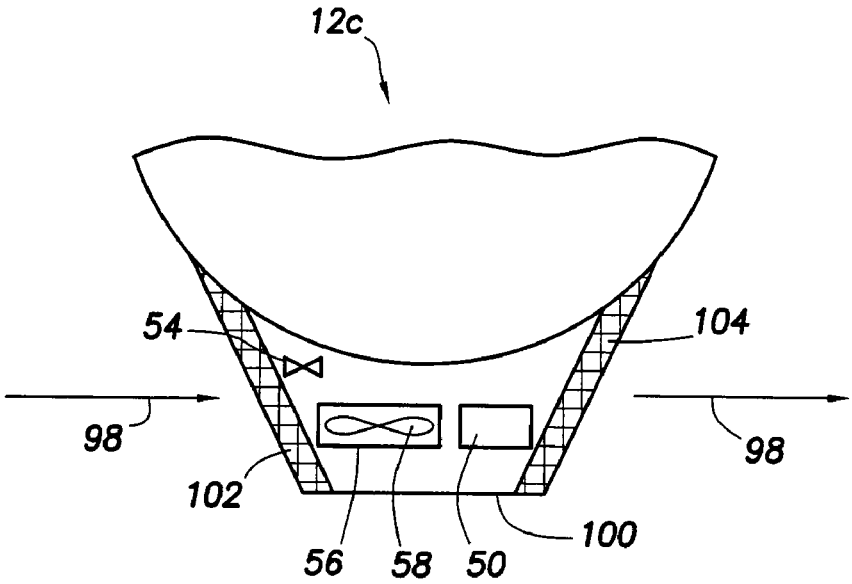
FIG. 9 is a simplified cross-sectional view through the FIG. 8 water heater taken along line 9-9 of FIG. 8.

An upper portion of a third alternate embodiment 12*c* of the previously described water heater portion 12 of the dual fuel system 10 is schematically shown in FIGS. 8 and 9. The water heater 12*c* may incorporate in an interior portion thereof the coiled air conditioning circuit condenser piping section 62 as utilized in any of the previously described water heater embodiments 12, 12*a* and 12*b*. Water heater 12*c* is similar to the previously described water heater 12*b* with the exceptions that (1) the water inlet and outlet pipes 30,31 and the flue pipe 38 exit the water heater 12*c* through its top end 18, and (2) the housing 90 on the top end 18 of water heater 12*b* is eliminated and replaced with a housing 100 secured to the vertical jacket side wall 44 on the water heater 12*c*. As schematically depicted in FIG. 9, the compressor, expansion valve, evaporator and evaporator fan portions 50,54,56,58 of the refrigerant circuit 14 are disposed within the housing 100. During operation of the refrigerant circuit 14, air 98 adjacent the housing 100 is flowed by the evaporator fan 58 sequentially into the housing 100 through an air inlet grille 102 thereon, across the evaporator 56, and then outwardly through an air outlet grille 104 on the housing 100 as cooled air 98. As in the case of the previously described water heaters 12-12*b*, the water heater 12*c* may be either a natural draft or forced draft water heater.

Figure 10:
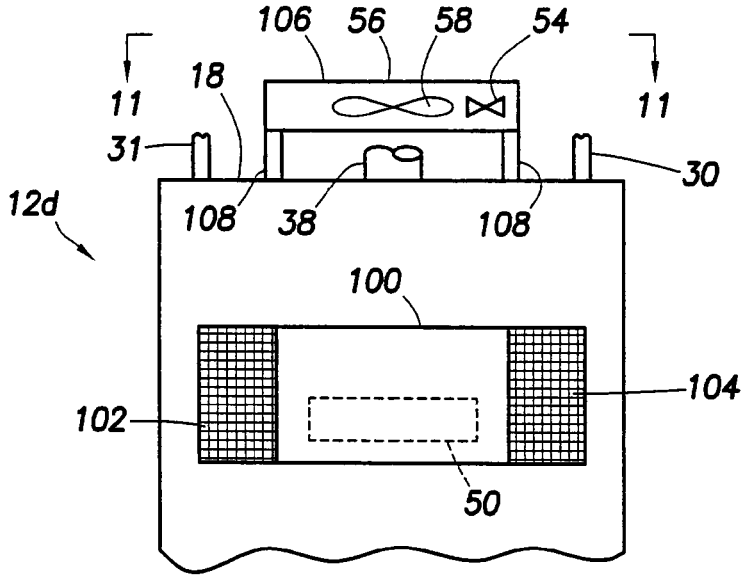
FIG. 10 is a simplified side elevational view of a top portion of a fourth alternate embodiment of the water heater.
Figure 11:
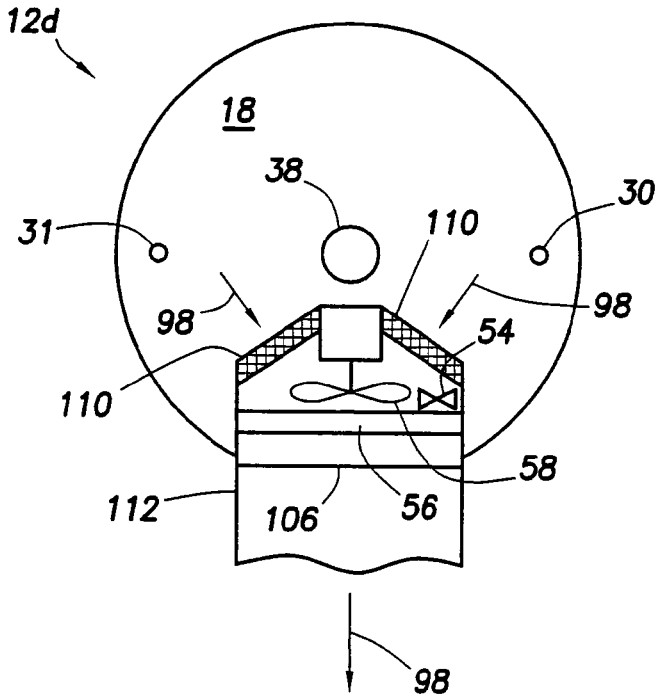
FIG. 11 is a top plan view through the FIG. 10 water heater taken along line 11-11 of FIG. 10.

An upper portion of a fourth alternate embodiment 12*d* of the previously described water heater portion 12 of the dual fuel system 10 is schematically shown in FIGS. 10 and 11. Water heater 12*d* is similar to the previously described water heater 12*c* with the exception that only the compressor 50 is disposed within the housing 100—the expansion valve, evaporator, and evaporator fan portions 54,56,58 of the refrigerant circuit 14 being disposed within a housing 106 supported as shown on the top water heater end 18, in an elevated relationship therewith, by suitable support legs 108. Housing 106 has a pair of air inlet grilles 110 thereon, and is connected to a cooled air supply duct 112. During operation of the circuit 14, the evaporator fan 58 sequentially flows adjacent air 98 into the housing 106 through the air inlet grilles 110, across the evaporator 56, and then outwardly through the duct 112, as cooled air 98, to a conditioned space served by the circuit 14. As in the case of the previously described water heaters 12-12*c*, the water heater 12*d* may be either a natural draft or forced draft water heater. As will be readily appreciated by those of skill in this particular art, any of the water heaters 12*a*-12*d* may be controlled using the control system 80 (see FIG. 12) previously described in conjunction with the water heater 12.

As can be seen from the foregoing, in representatively illustrated embodiments thereof the present invention provides a liquid heating system which may use either electrical energy or a combustible fuel as its power source, may be simply and easily controlled, compactly packages its air conditioning refrigerant circuit portion at the water heater portion of the system, and is of a mechanically simple construction.

The foregoing detailed description is to be clearly understood as being given by way of illustration and example only, the spirit and scope of the present invention being limited solely by the appended claims.

What is claimed is:

1. Apparatus for heating a liquid using either combustible fuel or electricity, said apparatus comprising:

a fuel-fired liquid heater having a tank for storing liquid for selective outflow from said tank, a fuel burner operative to create hot combustion gases, and a flue, extending through the interior of said tank, for receiving the hot combustion gases and transferring heat therefrom to liquid disposed within said tank;

an electrically powered air conditioning refrigerant circuit having a condenser portion including a piping structure, through which refrigerant flows during operation of said refrigerant circuit, disposed in an interior portion of said liquid heater and operative to transfer rejected condenser portion heat to liquid in said tank during operation of said air conditioning circuit; and a heat conduction barrier structure formed from a thermally insulative material and thermally insulating said piping structure and said flue against conductive heat transfer therebetween.

2. The apparatus of claim 1 wherein:

said liquid heater is a fuel-fired water heater.

3. The apparatus of claim 1 wherein:

said fuel-fired liquid heater further comprises a jacket structure outwardly surrounding an outer surface of said tank and defining therewith an insulation space therebetween, said piping structure is disposed within said insulation space in direct heat transfer contact with said outer surface of said tank; and said heat conduction barrier structure comprises insulation disposed within said insulation space.

4. The apparatus of claim 3 wherein:

said tank extends along an axis, and said piping structure is arranged in a coiled configuration about said axis.

5. The apparatus of claim 4 wherein:

said flue also extends along said axis.

6. The apparatus of claim 1 wherein:

said piping structure is disposed within the interior of said tank in a coiled configuration through which said flue passes.

7. The apparatus of claim 6 wherein:

said heat conduction barrier structure comprises a support structure for holding said piping structure in a radially outwardly spaced relationship with said flue, said support structure including a heat insulative material interposed between said flue and said piping structure.

8. The apparatus of claim 1 wherein:

said liquid heater has a housing supported thereon, said housing having spaced apart inlet and outlet openings therein through which air may be respectively received and discharged, and said refrigerant circuit further includes compressor, evaporator and expansion portions, with at least said compressor portion being disposed within said housing.

9. The apparatus of claim 8 wherein:

said compressor, evaporator and expansion portions are disposed in said housing.

10. The apparatus of claim 8 wherein:

said liquid heater has a top end on which said housing is mounted.

11. The apparatus of claim 8 wherein:

said liquid heater has a vertically extending side portion on which said housing is mounted.

12. The apparatus of claim 8 wherein:

said liquid heater has a top end on which said evaporator portion is mounted, and a vertically extending side portion on which said housing is mounted.

13. The apparatus of claim 1 further comprising:

a control system operable to selectively (1) permit operation of said fuel burner and lock out operation of said refrigerant circuit, or (2) operate said refrigerant circuit and preclude operation of said fuel burner.

14. The apparatus of claim 13 wherein:

said control system further includes an outdoor temperature sensor operative to output a temperature signal when the sensed outdoor temperature is below a predetermined magnitude, and said control system is further operable to lock out operation of said refrigerant circuit in response to generation of said temperature signal.

15. Apparatus for heating a liquid using either combustible fuel or electricity, said apparatus comprising:

a fuel-fired liquid heater having a tank for storing liquid for selective outflow from said tank, a fuel burner operative to create hot combustion gases, and a flue, extending through the interior of said tank, for receiving the hot combustion gases and transferring heat therefrom to liquid disposed within said tank;

an electrically powered air conditioning refrigerant circuit having a condenser portion including a piping structure disposed in an interior portion of said liquid heater and operative to transfer rejected condenser portion heat to liquid in said tank during operation of said air conditioning circuit, said piping structure being disposed within the interior of said tank in a coiled configuration through which said flue passes; and a support structure for holding said piping structure in a radially outwardly spaced relationship with said flue, said support structure defining a heat conduction barrier between said flue and said piping structure, said support structure including a circumferentially spaced series of elongated thermally insulative members longitudinally extending generally parallel to said flue, and held radially outwardly apart from said flue and around which said piping structure is coiled.

16. The apparatus of claim 15 wherein:

said insulative members are of a ceramic material.

17. The apparatus of claim 15 wherein:

said insulative members have longitudinally spaced lateral support projections thereon between which coils of said piping structure are supported.

18. The apparatus of claim 15 wherein:

said liquid heater is a fuel-fired water heater.

19. The apparatus of claim 15 further comprising:

a control system operable to selectively (1) permit operation of said fuel burner and lock out operation of said refrigerant circuit, or (2) operate said refrigerant circuit and preclude operation of said fuel burner.

20. The apparatus of claim 19 wherein:

said control system further includes an outdoor temperature sensor operative to output a temperature signal when the sensed outdoor temperature is below a predetermined magnitude, and said control system is further operable to lock out operation of said refrigerant circuit in response to generation of said temperature signal.

21. A water heater operable using either combustible fuel or electricity, comprising:

a tank for storing water to be heated, said tank having an exterior surface portion;

a jacket structure extending outwardly around said exterior surface portion of said tank and forming therebetween an insulation space;

insulation disposed within said insulation space;

a combustion chamber disposed beneath said tank;

a fuel burner disposed within said combustion chamber and operative to create hot combustion products therein;

a flue, communicating with said combustion chamber and extending through the interior of said tank, for receiving the hot combustion products and transferring heat to water disposed within said tank;

an electrically powered air conditioning refrigerant circuit having a condenser portion including a piping structure, through which refrigerant flows during operation of said refrigerant circuit, disposed within an interior portion of said water heater and operative to transfer rejected condenser portion heat to water in said tank during operation of said refrigerant circuit; and a heat conduction barrier structure formed from a thermally insulative material and thermally insulating said piping structure and said flue against conductive heat transfer therebetween.

22. The water heater of claim 21 wherein:

said tank has opposite ends spaced apart along an axis, and said piping structure is coiled about said axis.

23. The water heater of claim 22 wherein:

said piping structure is disposed within said insulation space and is in direct heat conductive contact with said exterior surface portion of said tank, and said heat conduction barrier structure includes said insulation.

24. The water heater of claim 21 wherein:

said piping structure is disposed within the interior of said tank and is coiled around said flue in a laterally outwardly spaced relationship therewith; and said heat conduction barrier structure includes a heat insulative material interposed between said piping structure and said flue.

25. The water heater of claim 21 wherein:

said fuel burner is a gas burner.

26. The water heater of claim 21 further comprising:

a control system operable to selectively (1) permit operation of said fuel burner and lock out operation of said refrigerant circuit, or (2) operate said refrigerant circuit and preclude operation of said fuel burner.

27. The water heater of claim 26 wherein:

said control system further includes an outdoor temperature sensor operative to output a temperature signal when the sensed outdoor temperature is below a predetermined magnitude, and said control system is further operable to lock out operation of said refrigerant circuit in response to generation of said temperature signal.

* * * * *